United States Patent [19]

Pugh et al.

[11] 4,034,875

[45] July 12, 1977

[54] LOAD HANDLING VEHICLE

[75] Inventors: Stuart Pugh, Loughborough; Eric Colley, Leicester, both of England

[73] Assignee: The Liner Concrete Machinery Company Limited, Wear, England

[21] Appl. No.: 621,449

[22] Filed: Oct. 10, 1975

[30] Foreign Application Priority Data

Oct. 12, 1974 United Kingdom ..... 44296/74

[51] Int. Cl.[2] ..... B66C 23/00; B66F 9/22

[52] U.S. Cl. ..... 214/141; 137/355.17; 137/355.24; 212/55

[58] Field of Search ..... 137/355.16, 355.17, 137/355.2, 355.23, 355.24, 26; 214/131, 140, 141, 147, 146.5; 212/55

[56] References Cited

U.S. PATENT DOCUMENTS

| | | | |
|---|---|---|---|
| 3,391,875 | 7/1968 | Hamrick | 137/355.23 X |
| 3,623,501 | 11/1971 | Reimbold | 137/355.17 |

*Primary Examiner*—Irwin C. Cohen
*Attorney, Agent, or Firm*—Sughrue, Rothwell, Mion, Zinn & MacPeak

[57] ABSTRACT

A load handling vehicle is described, having a chassis provided with wheels, an engine, and a control cab, and a telescopically extensible boom mounted pivotally on supports extending up from the rear of the chassis and a load handling carriage on the free end of the boom. The boom and carriage are hydraulically operated. Hydraulic lines to rams for extending the boom and for operating the lifting carriage are provided by a set of flexible pipes rigidly secured to the trailing end of an outermost section of the boom, and a roller is mounted on the trailing end of an intermediate section of the boom. A shrouded probe supporting the pipes within the boom extends from the innermost boom section into the other sections of the boom, locating the pipes around the roller.

4 Claims, 5 Drawing Figures

LOAD HANDLING VEHICLE

Figure 1:
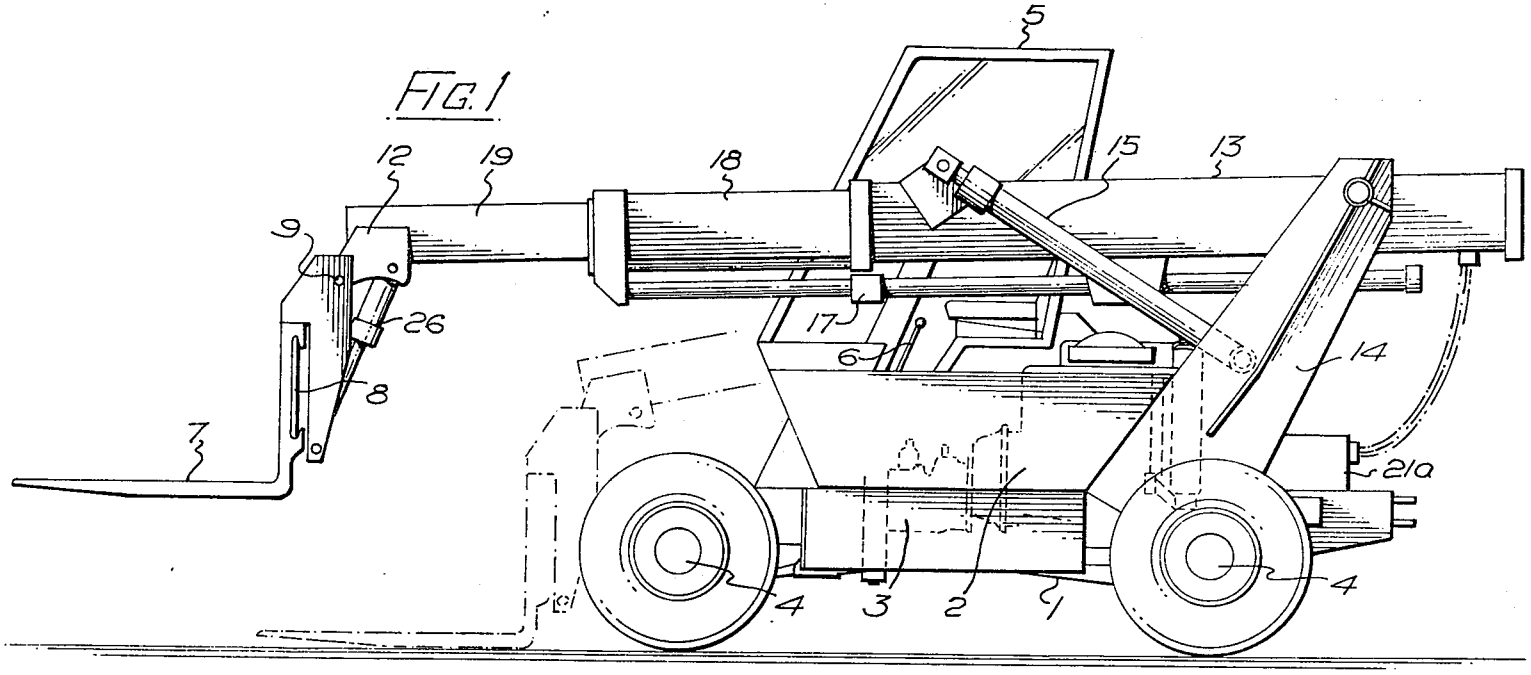

Priority is claimed from Oct. 12, 1974, the date of filing application no. 44296/74 in Great Britain.

This invention concerns improvements in and relating to load handling vehicles having powered equipment, for example, a lift carriage or other movable device operable by fluid under pressure and carried on a telescopically extensible boom.

The provisions of hydraulic services at the end of the boom, for example three or four jacks for positioning side shifts, levelling mechanism, grabbing or lifting devices, presents a problem in accomodating the many fluid transmission hoses during extension and contraction of the boom.

For transferring fluid under pressure for operating a jack to raise the forks or platform of a forklift carriage the hydraulic hoses required have been let off from hose reels or carried over pulleys carried for extension of a 2:1 ratio basis, however this is not satisfactory in the case of more sophisticated load handling machinery whose booms have two extensible sections and further difficulties are experienced in cases where the booms are required to extend at a horizontal inclination arising from friction on the hose, which sags under the action of gravity and is liable to be trapped by parts of the boom.

An object of the invention is to provide for improved hose support in transporting pressure fluid within the telescopically extensible boom.

According to the invention there is provided a load handling vehicle having powered equipment operable by fluid under pressure, provided with a set of pipes rigidly secured to the trailing end of an outermost section of a telescopically extensible boom, a roller rotatably mounted on the trailing end of an intermediate extensible boom section, the pipes being secured to the outermost boom section and extending inside the other sections from the leading end of the outer section.

The pipes may jointly be housed within a tapering shroud with a wedge or conical portion on the free end region thus facilitating entry into the innermost section and thus avoid undue obstruction by internal protruberances when the section is retracted along with the intermediate section. A set of flexible hoses respectively connected to the pipes extending from the wedge shaped section run back down all three sections, around the roller on the trailing edge of the intermediate section to a further set of pipes rigidly located within the inner extensible boom section and running the length thereof.

Pressure fluid may be introduced to the boom sections by flexible hoses from a powered source by way of a manifold block or suitable fastenings so that the roller carrying the flexible hoses can pass over the manifold without fouling it. The manifold is preferably resiliently mounted so that the steel pipes can flex the boom's extension and retraction thus avoiding undue stresses to the rigid piping within the boom section.

The vehicle may be constructed for operation on rough terrain, having sufficient body clearance for avoiding upwardly projecting obstacles and adapted for the provision of rugged agricultural tyres with a heavy tread for negotiating surface inequalities and mounting minor obstacles e.g. bricks on building sites; it is usually powered preferably for providing traction on two or more ground wheels.

Figure 2:
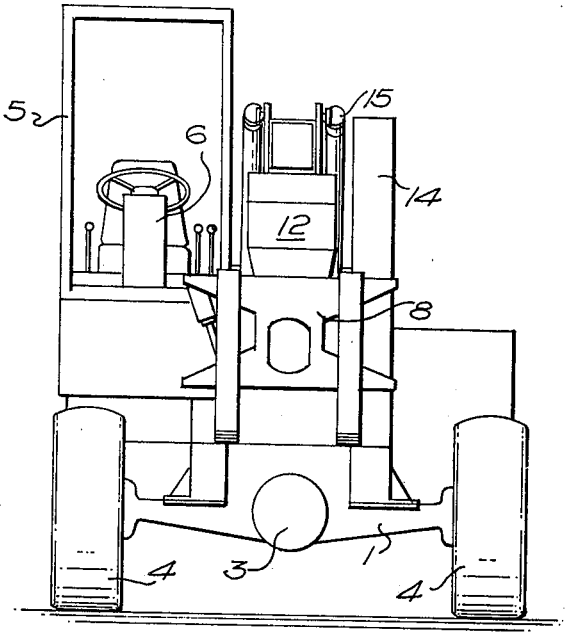
Figure 3:
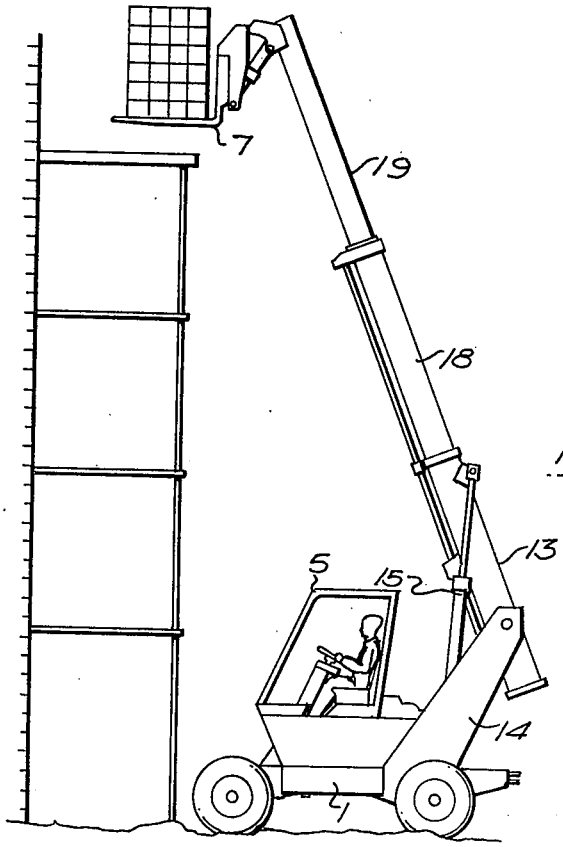
Figure 4:
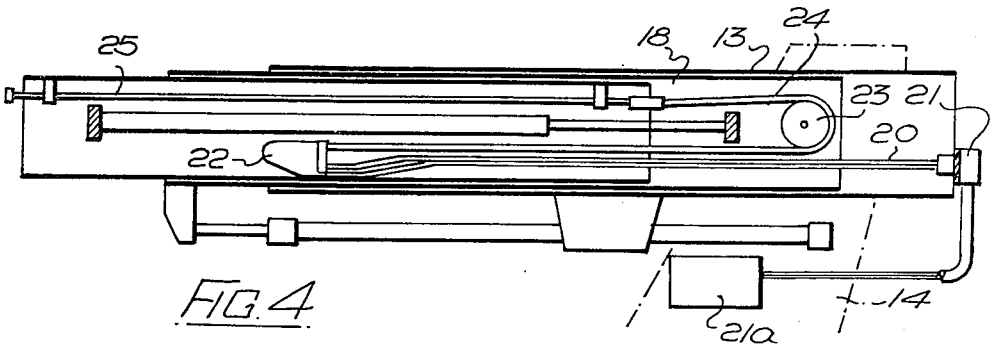
Figure 5:
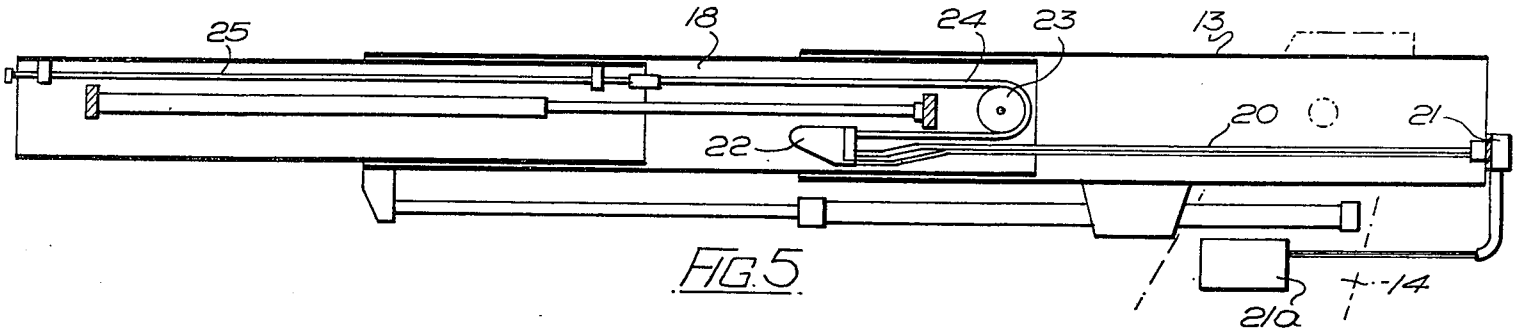

This invention will now be described further by way of example with reference to the accompanying informal drawings in which FIG. 1 shows side elevation of the vehicle, FIG. 2 shows an end elevation of the vehicle FIG. 3 shows the vehicle in operation and FIG. 4 shows a sectional view of the vehicle boom in its retracted position and FIG. 5 shows a sectional view of the vehicle boom in its extended position.

The chassis 1 has mounted on it an engine 2, gearbox 3 and four wheels on hubs 4. The four wheels are driven by the engine 2 and both front and rear pairs of wheels may be steered either in sympathy or in opposition to the other pair by which means a very tight turning circle may be obtained and the vehicle may perform crabbing movements.

The driver/operator is protected by an all-round view of cab 5 and operates the vehicle by means of a steering wheel and levers 6. The cab is formed from high grade steel and has toughened glass windows for driver/operator safety and the cab is positioned at the side of the chassis whereby the driver/operator may have a clear view of the forklift carriage or other mechanical handling device at all positions of the boom.

Forks 7 are mounted on a back plate 8 to form a forklift carriage which is held by a pivot and the pivotal motion of the carriage is controlled by a tilt controlling hydraulic ram, not shown, and a gravity sensing device mounted on the carriage whereby the gravity sensing device detects any tilt in the carriage's position about the axis through the pivot and actuates the tilt controlling ram to correct the carriage's position, the forks are thus kept in a controlled position with regard to the horizontal plane and the vehicle is thus enabled to pick up and off-load on uneven ground. A manual override may be used to purposely tilt the carriage when required.

The pivot for the back plate 8 is secured to a hinge plate 12 which itself is pivotable about a pivot rod 9 and controlled by a pivot control hydraulic ram 26 by which means the fork carriage may be given a sufficient angle of repose to provide safety during loading and unloading operations as the boom 13, 18 and 19 is raised and lowered by means of elevation controlling rams 15 and to allow the fork carriages to engage or disengage a pallet. The pivot control ram 26 and the elevation control rams 15 are operated by side by side levers on control valves in the cab 5 whereby both levers may be operated simultaneously by one hand, the hydraulic circuits for the rams have metering valves whereby simultaneous operation may be obtained to keep the forks level when the boom is raised or lowered.

The hinge plate 12 is slideable on the back plate 8 and controlled by a slide control ram (not shown) operated from a further control valve in the cab whereby the carriage may be slid from side to side to facilitate loading and unloading operations without the driver/operator having to move his vehicle.

The telescopic boom 13 is hinged at the rear of th vehicle to a rear chassis member 14 and elevated by the elevation control rams 15 through hinge points 16. The boom is extended by a boom extension ram 17 which forces the second boom member 18 to extend. The inner third boom member is forced to extend by a chain and pulley system between the sections. By this means the desired height or reach of the carriage may be obtained. The boom is retracted in the reverse manner.

An hydraulically actuated load sensor is coupled to the ram 15, operative at a predetermined load setting corresponding to but less than, the turning moment required to overturn the vehicle. The load sensor is connected to a locking device preventing valve movements to retract ram 15 and extend ram 17 and to illuminate warning light in the cab 5. Upon such safety cut-out occuring the operator retracts the telescopic boom before lowering it further.

Referring now to FIGS. 4 and 5, a set of three or more pairs of steel pipes 20, lead from a resiliently mounted manifold block 21, at the trailing end of the outer section 13, of the boom and extend through all three sections to a position approximating to the leading edge of the intermediary section 18. The pipes are then bent through 180° in a wedge or conical shaped cone 22, so that they face back down the boom towards the grooved roller 23. Pairs of flexible pipes 24, then take the fluid pressure from the steel pipes as they emerge from the nose cone 22, back down the boom and around the roller 23 where they joint with a further set of steel pipes 25, located on the uppermost side of the inner section of the boom. Further sets of flexible hoses then carry the pressure fluid to various rams, jacks, fluid motors ectetera, positioned at the end of the boom. When the boom is extended by the ram 17, the nose cone 22 and steel pipes 20 remain in the same position relative to the outer boom section. When the boom is fully extended the nose cone 22, will be resting on the intermediary boom section 18. When the boom is retracted the nose cone 22 guides the steel pipes 20 over any protuberances inside the boom sections as the sections are retracted.

What we claim is:

1. In a load handling vehicle having powered equipment operable by fluid under pressure conducted thereto by pipes, said vehicle having an extensible boom with telescoping sections, the improvement comprising: a first set of rigid pipes rigidly secured to the trailing end of an outermost section of the telescopically extensible boom and extending therethrough to a position adjacent the loading end thereof, a roller rotatably mounted on the trailing end of an intermediate section of the extensible boom, said second set of pipes being flexible and disposed in the intermediate boom section and flexibly extending around said roller from the trailing end of the inner section of the extensible boom to a coupling connecting the first and second sets of pipes together at the position adjacent the leading end of the outermost section whereby fluid pressure is supplied to said equipment through said boom at any telescoping position thereof.

2. A vehicle according to claim 1 wherein said coupling is a tapering shroud and said first set of pipes includes bent ends directed in said coupling towards the roller on the trailing end of the intermediate section.

3. A vehicle according to claim 2 wherein said set of flexible hoses are respectively coupled to a third set of rigid pipes located within the inner extensible boom section and running the length thereof.

4. A vehicle according to claim 3 wherein a resiliently mounted manifold block is provided on said outermost boom section and connected to said first set of pipes, flexible hoses connected to said manifold block, whereby pressure fluid is introduced to the boom sections and the first set of pipes can flex during the extension and retraction of the boom.

* * * * *